United States Patent [19]

Nagashima

[11] 4,427,288

[45] Jan. 24, 1984

[54] IMAGE FORMING APPARATUS

[75] Inventor: Nao Nagashima, Tokyo, Japan

[73] Assignee: Canon Kabushiki Kaisha, Tokyo, Japan

[21] Appl. No.: 343,188

[22] Filed: Jan. 27, 1982

Related U.S. Application Data

[62] Division of Ser. No. 188,230, Sep. 17, 1980.

[30] Foreign Application Priority Data

Sep. 26, 1979 [JP] Japan ..... 54-123631
Sep. 26, 1979 [JP] Japan ..... 54-123632

[51] Int. Cl.[3] ..... G03G 15/00

[52] U.S. Cl. ..... 355/14 R; 355/3 R; 355/14 C

[58] Field of Search ..... 355/14 R, 14 C, 3 R; 340/706, 715, 713; 370/24; 364/518, 900

[56] References Cited

U.S. PATENT DOCUMENTS 4,162,396 7/1979 Howard et al. ..... 355/14 C
4,190,350 2/1980 Donohue et al. ..... 355/14 R
4,202,622 5/1980 Kawatsura et al. ..... 355/14 C
4,243,313 1/1981 Masuda et al. ..... 355/14 R
4,251,769 2/1981 Ewert et al. ..... 340/715 X
4,343,036 8/1982 Shimizu et al. ..... 364/518

*Primary Examiner*—A. C. Prescott
*Attorney, Agent, or Firm*—Fitzpatrick, Cella, Harper & Scinto

[57] ABSTRACT

Image forming apparatus includes a feeder unit feeding a recording member, processing devices forming an image on the recording member, an input and output device having a port selectively usable for data input and output, a selector device for determining whether the port of the input and output device is used for data input or output, an instruction device connected to the input and output device and supplying enable instructions to the feeder unit and processing devices, and a display connected to the port and interrupting a normal display to display indications corresponding to the signals appearing on the port in response to the selector device determining that the port is used for data input.

4 Claims, 5 Drawing Figures

IMAGE FORMING APPARATUS

This is a division of application Ser. No. 188,230, filed Sept. 17, 1980.

BACKGROUND OF THE INVENTION

1. Field of the Invention

The present invention relates to an image forming apparatus having a display device usable as an input device.

2. Description of the Prior Art

With the recent progress in the microcomputer technology, general purpose input-output circuits are employed for control and display of copiers. For example in FIG. 1, a microcomputer 1 controls a general purpose input-output circuit 2 provided with three ports having eight terminals each, in which the port 1 for example is used for data input while the ports 2 and 3 are used for data output under the control of said microcomputer. The data input and output from and to said ports are conducted through a data bus.

Usually each port of such general purpose input-output circuit is assigned exclusively for data input or output. In certain instances, however, it is not possible to increase the number of such general purpose input-output circuits because of excessive cost or the large space required for mounting the components.

SUMMARY OF THE INVENTION

An object of the present invention is to provide an apparatus capable of avoiding such limitations and allowing the use of the port normally assigned exclusively for data input or output, as well as for the purpose of data output or input, respectively, when necessitated.

Another object of the present invention is to provide a display device allowing the use of the port normally assigned for display, in an input-output circuit utilizing a general purpose input-output LSI, for data input by appropriate switching, and also allowing the display of the input data by a display circuit.

Still another object of the present invention is to provide an image forming apparatus allowing to use the port normally assigned, in an input-output circuit, for the display of process conditions and sequence also as the input port for various instruction signals and detection signals.

The foregoing and other objects of the present invention will be made apparent from the following description of the preferred embodiments.

DESCRIPTION OF THE PREFERRED EMBODIMENTS

Figure 1:
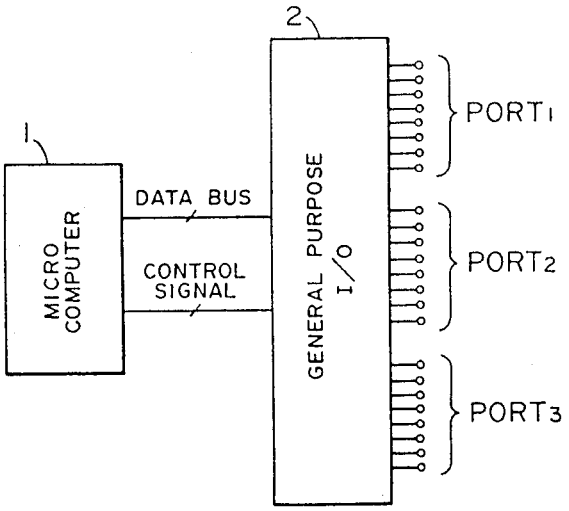
FIG. 1 is a schematic view of a general purpose input-output circuit controlled by a microcomputer.
Figure 2:
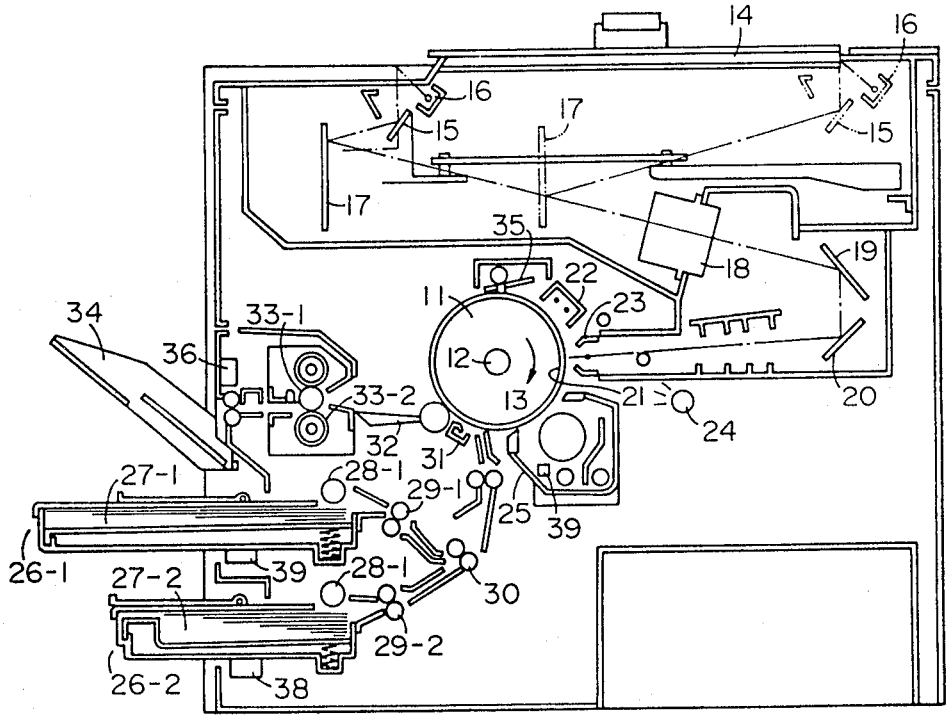
FIG. 2 is a cross-sectional view of a copying apparatus in which the present invention is effectively applicable.

Reference is at first made to FIG. 2 showing, in a cross-sectional view, a copier in which the present invention is effectively applicable.

A drum 11, provided on the periphery thereof with a three-layered photosensitive member utilizing CdS as the photoconductor, is rotatably supported on a shaft 12 and initiates rotation in the direction of arrow 13 in response to a copy instruction.

Upon arrival of said drum 11 at a predetermined position, an original placed on a glass plate 14 constituting the original carriage is illuminated by a lamp 16 formed integral with a first scanning mirror 15, and the reflected light is scanned by said first scanning mirror 15 and a second scanning mirror 17, which are displaced with a speed ratio of 1:½ to achieve the scanning of said original while maintaining a constant optical path length in front of a lens 18.

Said reflected light is guided through said lens 18, a third mirror 19 and a fourth mirror 20 and is focused on said drum 11 in an exposure station 21.

Said drum 11 is at first charged, for example positively, by means of a primary charger 22, and is then subjected, in said exposure station 21, to a slit exposure of the image illuminated by said lamp 16.

Simultaneously with said exposure, said drum is subjected to an AC charge elimination or a charge elimination of an opposite polarity (for example negative) to that of said primary charging by means of a charge eliminator 23, and is then exposed uniformly to a whole-surface exposure lamp 24 to form an electrostatic latent image of an elevated contrast on said drum 11. Said electrostatic latent image is then rendered visible as a toner image by a developing station.

A transfer sheet 27-1 or 27-2 stored in a cassette 26-1 or 26-2 is advanced into the apparatus by a paper feed roller 28-1 or 28-2, and is further supplied toward the drum 11 under approximate timing adjustment by a first register roller 29-1 or 29-2 and under precise timing adjustment by a second register roller 30.

The toner image formed on the drum 11 is transferred onto said transfer sheet 27 during the passage thereof between the drum 11 and a transfer charger 31.

Upon completion of the image transfer, the transfer sheet is guided through a conveyor belt 32 to paired fixing rollers 33-1, 33-2 wherein thus transferred image is fixed by heat and pressure, after which the transfer sheet is ejected to a tray 34.

The drum 11 after the image transfer is subjected, in a cleaning station 35 composed of an elastic blade, to surface cleaning and proceeds then to the succeeding image forming cycle.

There are also provided a jamming detector 36 composed for example of a photoelectric element and adapted for releasing a jamming signal when the transfer sheet is not detected at predetermined timings; paper detectors 37, 38 composed for example of photoelectric elements and adapted for releasing detection signal in case of the absence of copying sheets in the corresponding cassettes; and a toner detector 39 composed for example of a photoelectric element for detecting the amount of the toner in the developing station and adapted for releasing a detection signal in case of the absence of said toner.

Figure 3:
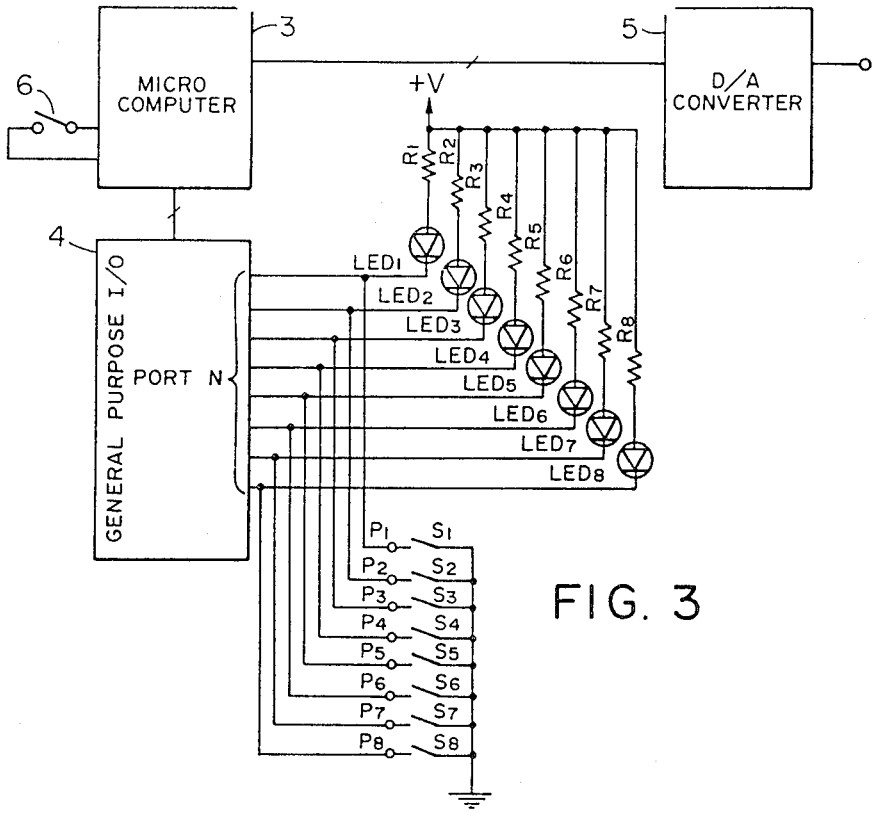
FIG. 3 is a block diagram of a circuit in which an output port for display is also usable as an input port for instruction signals.
Figure 4:
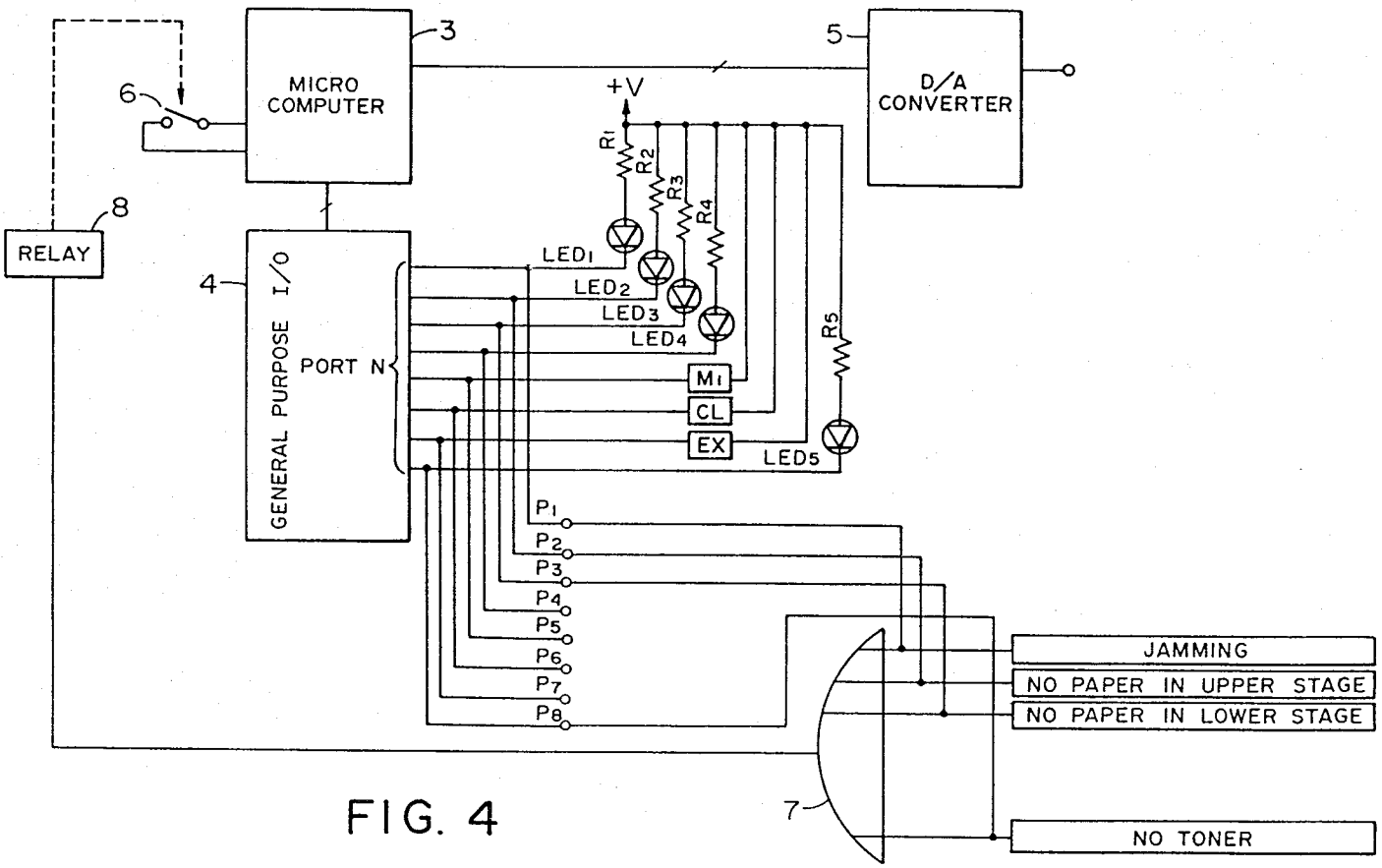
FIG. 4 is a block diagram of a circuit in which an output port for copying process and display is also used as input port for trouble detection signals.

FIGS. 3 and 4 are block diagrams showing embodiments of the present invention, wherein an output port for the display of process conditions and of sequence is also used for the input of various detection signals and instruction signals. In FIG. 3 there are shown an 8-bit parallel-processing microcomputer 1 for controlling the process sequence and the display; a general-purpose input-output LSI 4 for releasing the signals for sequence and display control and for entering the condition signals and trouble signals; an 8-bit digital-analog (D/A) converter 5 for converting the digital signals into the analog signals to be supplied to a high-voltage transformer; a switch 6 for switching the input-output port of said input-output LSI for data output and data input respectively in the off- and on-state respectively, whereby the input-output function of said input-output LSI 4 and of said D/A converter 5 is controlled by said microcomputer 1; light-emitting diodes LED1–LED8 for process display, driven by a voltage +V; current control resistors R1–R8; and microswitches S1–S8 for signal entry to input terminals P1–P8. Said light-emitting diodes LED1–LED8 are lighted or are not lighted, respectively, when the voltage of a port N connected thereto is lower than or equal to the pull-up voltage +V, and are utilized for an arbitrary display mode such as the contrast display, ordinarily according to a program stored in a read-only memory of the microcomputer 1.

In realizing the present embodiment there may be employed for example the microcomputer 8048 manufactured by Intel Corp., which has the microcomputer 1 and the general-purpose input-output LSI 4 shown in FIG. 3 in combination and is provided with the functions of:

an 8-bit CPU;
1k×8 ROM program memories;
64k×8 RAM data memories;
27 input/output lines; and
8-bit timer/event counter in a 40-pin single wrap package.

This microcomputer 8048 is driven by a single voltage of 5 V and has more than 90 instructions executed in one or two machine cycles with a cycle time as short as 2.5 to 5 microseconds.

27 signal lines for input-output of said microcomputer 8048 are divided into 3 ports of each 8 bits and 3 test input lines, wherein said ports are bidirectionally usable for input and output. Among these ports, the lines of the ports 1 and 2 are called quasibidirectional because of the special output circuit structure which allows each signal line to be used for input and/or output even if the output is statically latched.

Figure 5:
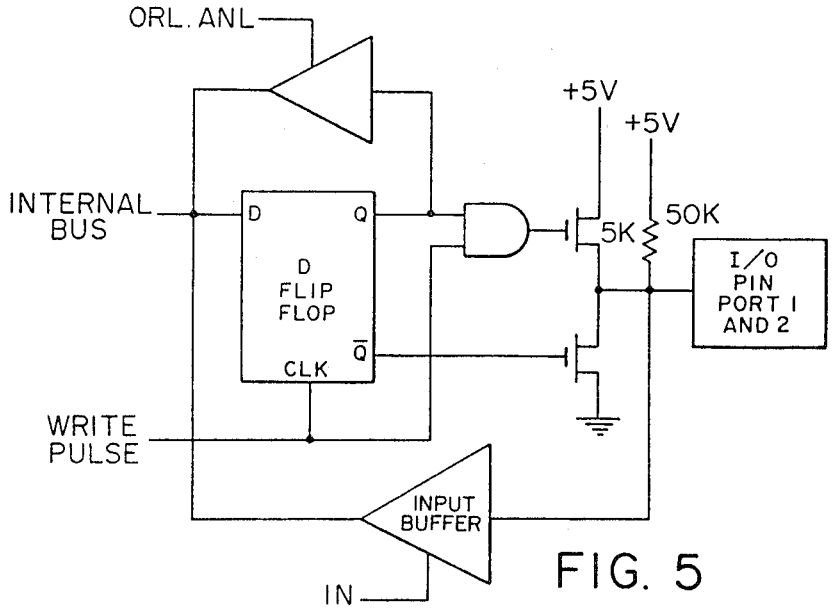
FIG. 5 is a block diagram of a bidirectional port of the microcomputer 8048.

Said circuit is detailedly shown in FIG. 5, in which each signal line is always connected to +5 V through a pull-up resistor of a relatively high impedance (1–50 kΩ) which provides a source current sufficient to maintain a high-level load to the TTL and which can still realize a level-0 state by the standard TTL gate. In this manner the same pin of the chip can be utilized both for the signal input and output.

It is constructed in such a manner that the switching is conducted with a relatively low impedance (~5 kΩ) when a level-1 signal is supplied to the signal line in order to achieve a rapid switching at the shift from level-0 to level-1. In fact this switching is conducted instantaneously (~500 ns).

On the other hand, when a level-0 signal is supplied to the signal line, a low impedance element (~3 kΩ) overrides a high impedance element, thereby enabling a sink current in the TTL. As the transistor causing such sink current is of a low impedance, a level-1 signal has to be written in beforehand in case the corresponding pin is to be utilized for data input.

A reset signal returns all the signal lines to the high-impedance initial level-1 state. This structure allows operation of the input and output signal lines in the same pin and mixing of the input signal lines in the same port. For example the input-output processing of a 1-bit signal line within an 8-bit processor by the combination of said quasibidirectional port and ANL, ORL logic instructions.

For the purpose of checking or adjustment of the apparatus, the switch 6 connected to the microcomputer 1 (or general-purpose input-output LSI 4) is closed for selecting the input function, whereby the port N is shifted to a voltage +V to extinguish the light-emitting diodes LED1–LED8 connected thereto and to enable the use of said port N as the input port through the input terminals P1–P8. In such case the input signals from the terminals P1–P8 can be entered in the input-output LSI 4 by closing the corresponding switches S1–S8. In case any of the input signals from the terminals P1–P8 is at the low level, the corresponding light-emitting diode is lighted to allow the confirmation of the input data. At the same time the microcomputer 1 introduces said input data into the CPU for processing and activating the D/A converter 5 to cause the function of a desired component in the apparatus, for example the corona charger. It is therefore possible for servicemen or an operator to calibrate the corona voltage according to the result of the image development.

It is also possible, for example by using relay, to connect a display circuit to the terminals of such input-output circuit for effecting any desired display in the normal state and to change over the switches upon detection of troubles such as paper jamming, lack of paper or lack of toner. This can be effected by entering the trouble signals from said terminals, thereby initiating necessary controls and displaying such troubles on the display circuit.

Furthermore it is possible to release the signals to the motor and other process components of the apparatus and to change over the switches upon detection of the aforementioned troubles thereby interrupting the signal supply to said components.

FIG. 4 shows an example of such structure, wherein the components 1 to 6 are the same as those shown in FIG. 3. There are also provided a relay M1 for rotating the drum motor, a relay CL for starting the function of the paper feed roller 28-2, a relay EX for turning on the lamp and causing the scanning motion of the mirrors, an OR gate 7, and a relay 8 for controlling the switch 6.

The output signals from the jamming detector 36, paper detectors 37, 38 and toner detector 39 are supplied to the terminals P1–P3 and P8, and also to said OR gate 7, which output signal controls the relay 8 to open or close the switch 6.

For example, in case of a paper jamming, a corresponding high-level trouble signal is supplied to the terminal P1 and also to the OR gate 7, which high-level output signal activates the relay 8 to close the switch 6, whereby the port N is activated as the input port. Thus the trouble signal from the input terminal P1 is introduced to the general-purpose LSI 4 and is processed by the microcomputer 1 to control the relays and so on for achieving necessary control, such as the termination of the function of the apparatus. Because the input signal from the input terminal P1 is of the high-level, the light-emitting diode LED1 is not lighted, indicating the presence of paper jamming. In this state the relays M1, CL and EX are deactivated due to the absence of output signals to prevent the functions of the motor, paper-feed roller and optical system. Also the high-voltage output is reduced by the D/A converter 5 to deactivate the corona charger. Similar functions are obtained also in the case of the absence of paper or of toner.

Also it is possible to employ the key signals for example for the entry of the copy number as the input signals and the signals to sequence loads as the output signals, and to construct the circuit in such a manner that said switch is opened upon actuation of the copy button, whereby the terminals are at first used for entering the copy number and then are switched for output upon actuation of the copy button, causing a sequence drive of said sequence loads in repeated cycles to obtain the copies of the selected number.

Furthermore, the signal generated by the on-off function of the switch 6 may be introduced to an interruption terminal of the microcomputer 1 to effect the switching of the ports by interruption processing. Also the control flow of the copying sequence may be so designed that the input signal from the switch 6 is sensed at an appropriate part of the sequence, for example at the beginning of the control flow for controlling the drum surface potential.

As explained in the foregoing, the present invention, allows the use of terminals ordinarily assigned for display in the input-output circuit such as a general-purpose input-output LSI, and as input terminals by a switch function. Thus, there is a reduction in cost and in the required mounting space for components as the same terminals can be used both for input and for output. Also the present invention allows the confirmation of the input data since the display circuit functions in response to the input data.

What I claim is:

1. A reproducing apparatus comprising:

a plurality of processing means for reproducing an image;

instruction means for selectively operating one of said means; and display means coupled to said instruction means for displaying data in response to a signal from said instruction means, wherein said display means interrupts a previous display in response to said enabling means and carries out a display in accordance with the signal from said instruction means.

2. The reproducing apparatus according to claim 1, wherein said instruction means and said display means have an input-output means.

3. The reproducing apparatus according to claim 2, where said input-output means is connected to one port so that input to and output from said instruction means and said display means can be made at the one port.

4. The reproducing apparatus according to claim 3, wherein said input-output means can be changed by said enabling means back and forth from a means for signal output to a means for signal input.

* * * * *

UNITED STATES PATENT AND TRADEMARK OFFICE

CERTIFICATE OF CORRECTION

PATENT NO. : 4,427,288

DATED : January 24, 1984

INVENTOR(S) : NAO NAGASHIMA

It is certified that error appears in the above-identified patent and that said Letters Patent is hereby corrected as shown below:

COLUMN 1

Line 45, "to use" should read --the use of--.

COLUMN 3

On each of lines 4, 26, and 29, "1" should read --3--.

COLUMN 4

Lines 26, 47 and 65, "1" should read --3--.

Line 32, after "using" insert --a--.

COLUMN 5

Line 21, "1" should read --3--.

UNITED STATES PATENT AND TRADEMARK OFFICE

CERTIFICATE OF CORRECTION

PATENT NO. : 4,427,288

DATED : January 24, 1984

INVENTOR(S) : NAO NAGASHIMA

It is certified that error appears in the above-identified patent and that said Letters Patent is hereby corrected as shown below:

CLAIM 1

Line 5, delete "and"

Between lines 5 and 6, insert --means for enabling an input signal to be entered into said instructions means; and--.

Signed and Sealed this

*Seventh* Day of *August 1984*

[SEAL]

*Attest:*

GERALD J. MOSSINGHOFF

*Attesting Officer*

*Commissioner of Patents and Trademarks*